United States Patent [19]

Tanner

[11] 3,946,990

[45] Mar. 30, 1976

[54] PORTABLE WINCH DEVICE

[76] Inventor: Troy Tanner, 3104 Emogene St., Mobile, Ala. 36606

[22] Filed: Oct. 9, 1974

[21] Appl. No.: 513,220

[52] U.S. Cl. ..... 254/164; 248/156

[51] Int. Cl.[2] ..... A63B 61/04

[58] Field of Search ..... 254/164, 166, 161; 248/156; 256/47, 49, 51; 403/387, 389, 391, 359; 52/753 T, 586; 296/28 M

[56] References Cited

UNITED STATES PATENTS

| | | | |
|---|---|---|---|
| 695,734 | 3/1902 | Kelly et al. | 254/164 |
| 951,111 | 3/1910 | Godwin | 254/164 |
| 1,177,767 | 4/1916 | Eggleston | 254/164 X |
| 1,198,215 | 9/1916 | Hahn et al. | 254/164 |
| 1,268,572 | 6/1918 | Heuer | 254/164 |
| 1,806,606 | 5/1931 | Booth | 254/164 X |
| 2,746,718 | 5/1956 | French | 254/164 X |

*Primary Examiner*—Robert R. Song
*Assistant Examiner*—R. Schrecengost
*Attorney, Agent, or Firm*—Peck & Peck

[57] ABSTRACT

An apparatus adapted for use in moving objects, such as mired vehicles, removing submerged or grounded boats from their mired condition and pulling them up on land to be repaired or loaded on trailers or the like, moving small buildings, etc. The apparatus is endowed with unusual versatility for it is adaptable to a great many uses. In many use circumstances the apparatus may be carried in a vehicle or the like for emergency use since it is composed of relatively few components so that under these circumstances it is in effect a portable kit. The components forming the apparatus may be easily set up into operative condition and operated by one person to perform its function. The puller apparatus comprises a fixed element which may be removably embedded in the ground in certain use circumstances and in other uses may be removably attached to a stationary member. A manually operative winch is attached to the fixed element and is operable to produce pulling movement on a rope or cable which is wound about the winch at one end and is removably attached at the other end thereof to the object which is desired to be moved.

3 Claims, 5 Drawing Figures

PORTABLE WINCH DEVICE

BACKGROUND OF THE INVENTION

While power generation devices, such as winches, are well known, as far as I am aware, prior to my invention there has been no such combination of elements, including a winch, which produces in a novel manner the results obtained by the combination of this invention.

The apparatus of this invention is portable and may be used in substantially any environment to move objects, and one of the many advantageous characteristics inherent in this innovation is the fact that the apparatus may be set up into operating condition by one person and may be operated by one person to generate the necessary power to move relatively heavy objects. It is to be recognized that it may also be disassembled into inoperative condition by one person.

Since the components of which the pulling apparatus is composed are relatively few in number, the apparatus is portable and may be carried in a vehicle as a puller kit or carried from place to place by any suitable means. Not only may this apparatus be used with facility in an outdoor environment, but it may be used with equal facility in an indoor area and for such use an arrangement is provided whereby a component of the apparatus is attached to an immovable element in the indoor area. It is to be appreciated that it may be set up, operated, and disassembled by one person whether it is used in an indoor or outdoor environment.

The components of the apparatus are relatively inexpensive to produce and are of simple construction and operate so that the assembler thereof, and the operator thereof, need have no special training in order to use it.

In the use of this apparatus it is essential that a member be provided which may be fixed in immovable position and is adapted to mount the winch. This member must be endowed with sufficient strength to withstand the bending and moving strains and stresses which will be applied to it when the winch is operated.

I have developed a member for this particular purpose which has the necessary strength characteristics, while not being cumbersome or unduly heavy. This member is adapted to be removably embedded in the ground in immovable position or to be removably attached to a fixed element in a building or the like.

DESCRIPTION OF THE INVENTION

Figure 1:
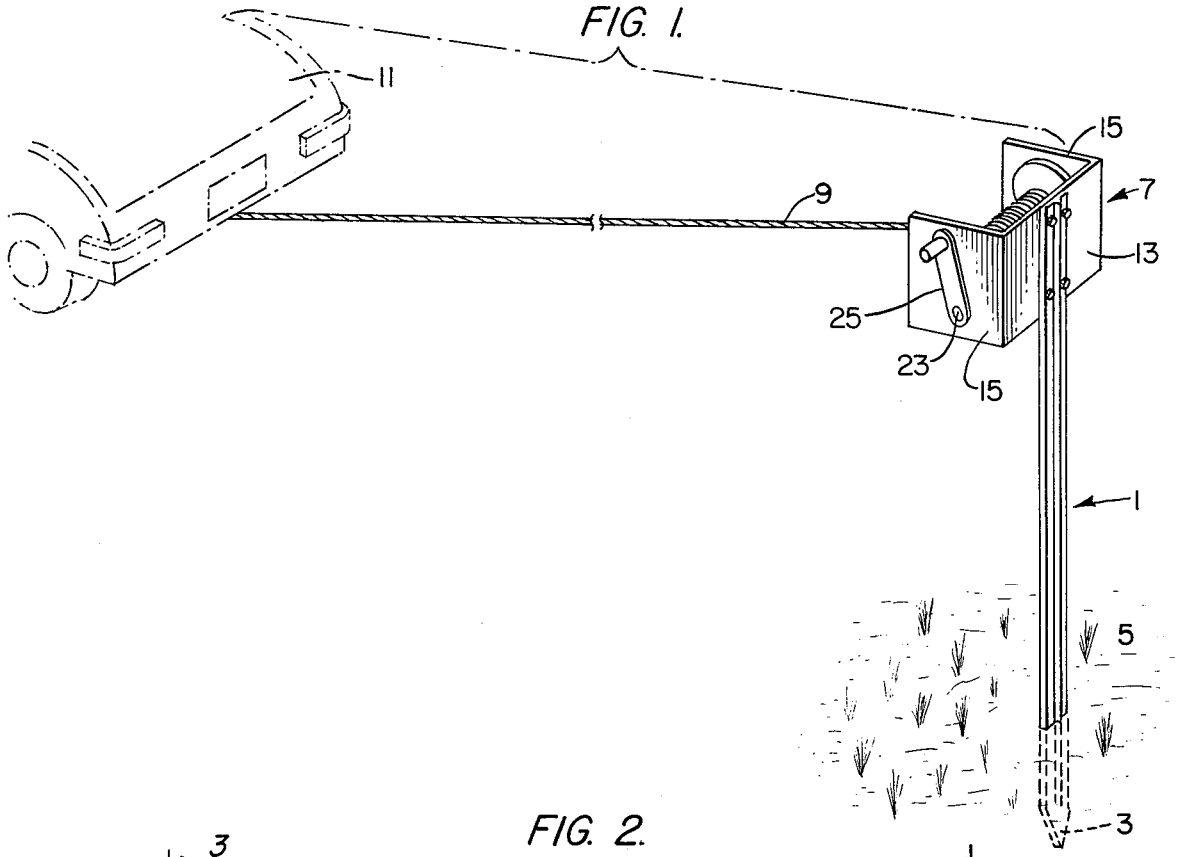
FIG. 1 is a view in perspective illustrating the various components of the apparatus in operative position for moving an object.
Figure 2:
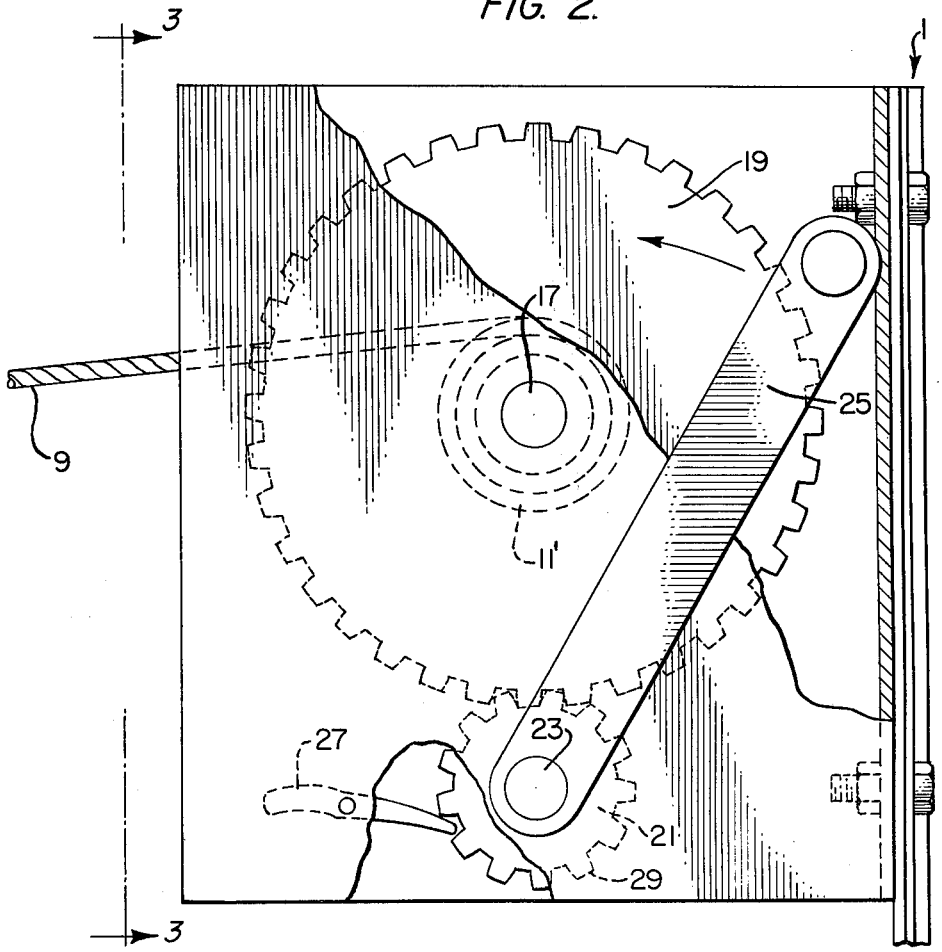
FIG. 2 is a view taken on line 2—2 of FIG. 3.
Figure 3:
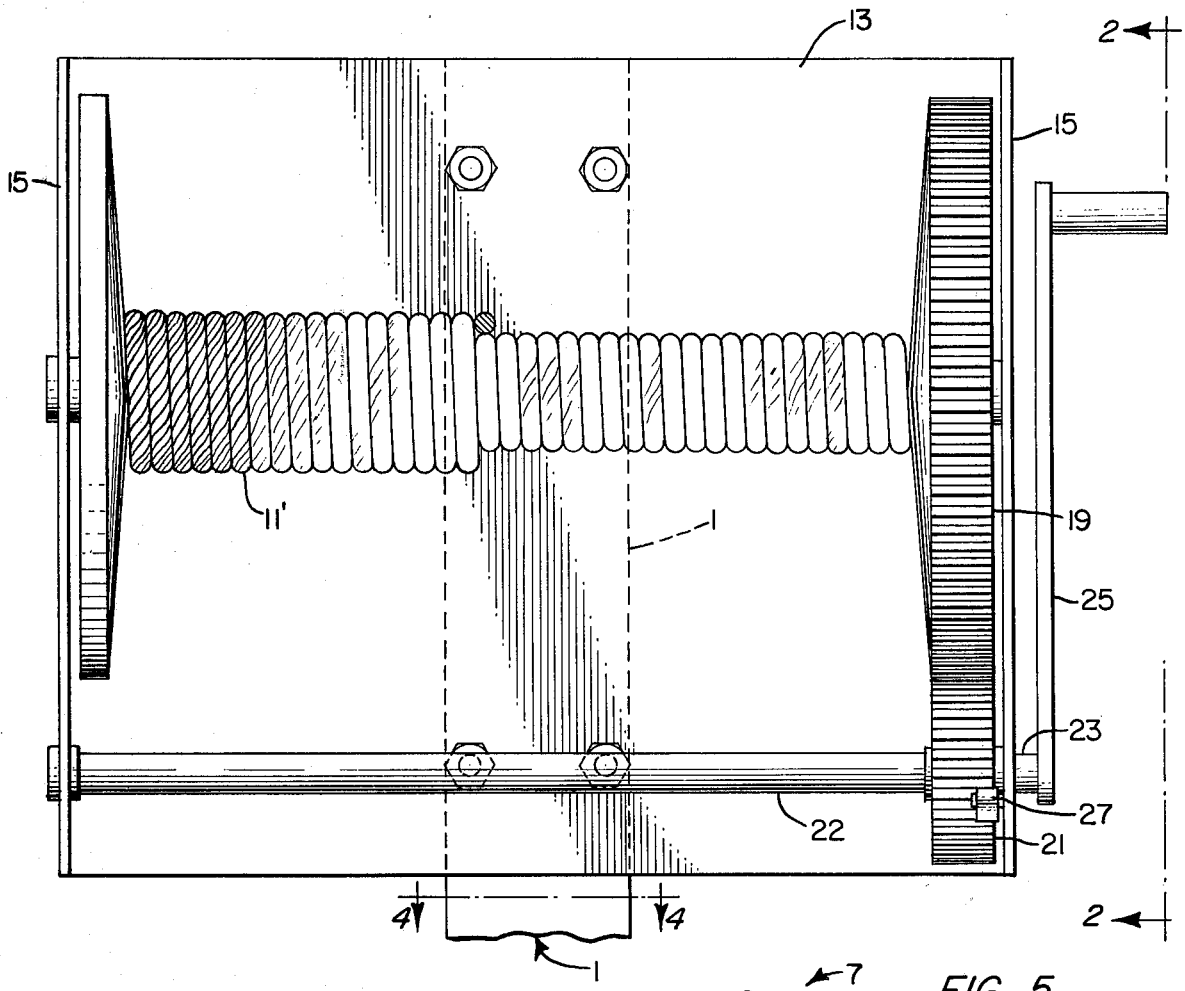
FIG. 3 is a view taken on line 3—3 of FIG. 2.

In the accompanying drawings I have used the numeral 1 to designate in its entirety the fixed member of the components of the entire apparatus. The fixed member 1 is of elongated shape in the nature of a post and is pointed at its lower end, as at 3, so that it may be embedded in the ground 5 with facility. When the member 1 is sufficiently embedded in the ground to extend upward therefrom a desirable distance it will be appreciated that the member 1 will be fixed in the ground against any lateral movement which might otherwise be imparted thereto when the apparatus is being operated to move an object. A winch designated generally by the numeral 7 is mounted in any suitable manner adjacent the upper end of the fixed member 1. In the conventional manner of winches a rope or cable 9 is coiled about the drum of the winch as at 11. The free end of the rope or cable 9 is provided with a hook (not shown) which is adapted to be removably attached to a fixed point on the object to be moved. As one example, from among many, I have illustrated the object to be moved as being a vehicle 11 which may be mired or otherwise inoperative and it is desired to move it out of its mired position and towards the fixed member 1 and winch 7.

The winch 7 may comprise a generally U-shaped bracket, comprising a back 13 and two spaced apart forwardly projecting arms or sides 15 which are preferably, though not necessarily, formed integral with the back 13. Rotatably mounted in and extending between the sides 15 is a drum 17 about which is coiled, in the usual manner, a rope or cable 9, as at 11. The drum is rotatably journaled in and extends between the sides 15 of the bracket. Fixed to the drum 17 at one end thereof is a large diameter multi-toothed gear 19. I provide a reduced diameter multi-toothed gear 21 which is in mesh with the large diameter gear 19. The gear 21 is fixed on a shaft 22 which is journaled in and extends between the sides 15 of the bracket. The shaft 22 extends outwardly beyond one side 15, as at 23, and fixed to such extension 23 is manually operated crank means 25. It will now be recognized that when the crank means 25 is manually operated gear 21 will be rotated and cause power generating rotation in the gear 19 to thereby rotate the drum 17 to cause the rope or cable 9 to be wound upon the drum. In order to releasably maintain the drum in any rotated position a pawl 27 is pivotally mounted on a side 15 so that its nose may be pivoted into locking or unlocking position with respect to the teeth 29 of the reduced diameter gear 21.

As I have mentioned above, the fixed member 1 must be endowed with sufficient strength to withstand the bending strains which are imparted to it when it is embedded in the ground and when the winch 7 is operated to move an object. I have evolved an ingenious fixed member which has these necessary and requisite strength characteristics. The fixed member 1 comprises an elongated base 31 which is pointed at its lower end as at 3 so it may be forced the necessary distance into the ground. The strengthening means for the member 1 which provides in effect a "strongback" member comprises a tee shaped spine designated generally by the numeral 33. This tee shaped spine extends from the top of the fixed member 1 a distance downwardly therealong to a point adjacent to but upwardly spaced from the point 3 of the member 1. The tee shaped spine member 33 consists of a base 34 which is preferably, though not necessarily, of less width than the width of the base 31 and is provided with an upstanding strengthening rib 37. The tee shaped spine 33 may be integrally formed with the base 31 or securely attached thereto in any suitable manner and the tee shaped spine is preferably formed on the fixed member 1 to extend along the rear side thereof, that is, the side thereof which is removed from the side to which the winch 7 is attached.

It will now be apparent that the all round puller which is disclosed in this invention consists of a fixed member on one end of which is attached a winch which is adapted to wind a rope or cable about the drum thereof. The free end of the rope or cable is provided with a hook which is adapted to be removably attached to the object to be moved. These components of which the apparatus is composed are portable, may be carried in a vehicle at all times to be operated when desired to move an object. I have explained that this apparatus may be used in a variety of situations, and to move a variety of objects with facility, and that it may be set up in operative position by one person and may be operated by one person to accomplish its purpose of moving an object.

As one example, from among many, of the uses to which this apparatus may be applied is its use in an outdoor environment for removing a mired or otherwise inoperative vehicle as particularly shown in FIG. 1 of the drawings. In this instance, the apparatus, comprising the components mentioned above, is carried in the vehicle and when the vehicle becomes mired or otherwise inoperative, it is merely necessary to remove the components of the apparatus from their stored position in the vehicle and to embed the fixed member 1 into the ground a sufficient distance so that the winch 7 may be operated. The rope or cable 9 is unwound from the drum of the winch and the free end of the rope or cable, which is provided with a hook (not shown), is attached to the vehicle by means of the hook. The operator of the apparatus after it has been set up and attached to the vehicle as described, then merely manually operates the crank 25 to cause the drum of the winch to rotate and wind the rope or cable thereon to pull the vehicle from its mired or otherwise inoperative position. This is not a difficult task since the winch through its gearing generates sufficient power to move the vehicle. It is also within my contemplation to use a motor or any suitable power means instead of manual means to operate the winch.

Figure 5:
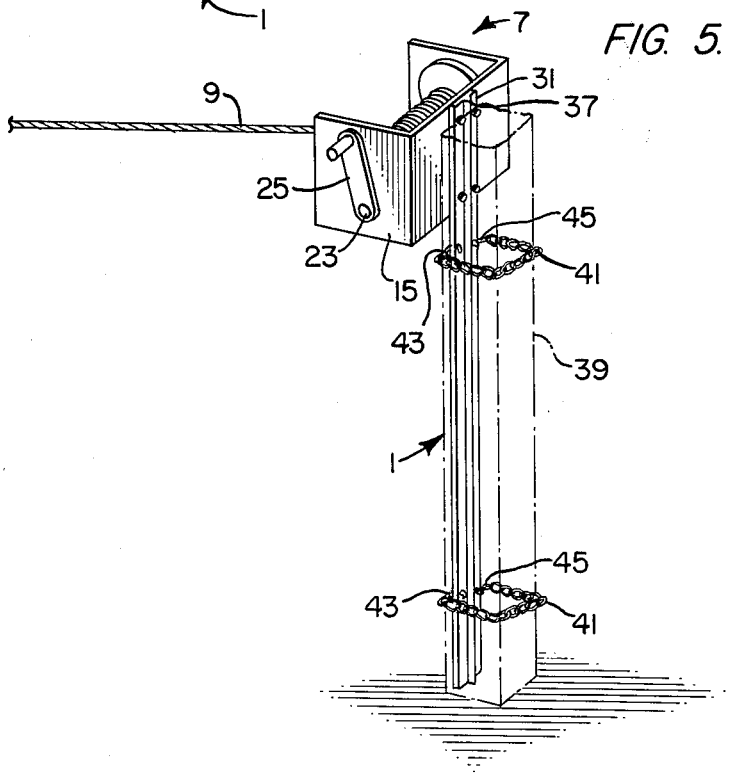
FIG. 5 is a perspective view of a further form of the apparatus, with parts thereof broken away, illustrating the member which mounts the winch releasably attached to an immovable element.
Figure 4:
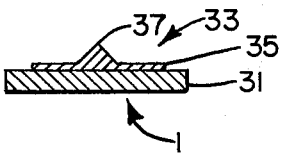
FIG. 4 is a sectional view through the member which is fixed when the apparatus is in operative position, particularly illustrating the strengthening means with which this member is provided.

In FIG. 5 of the drawings a form of the invention is illustrated which is particularly adapted for use in an indoor environment or in any environment which may be provided with floors or base surfaces of concrete or of any material which is impenetrable by the pointed end of the fixed member 1. In the description of this form of my invention I shall use the same reference numerals heretofore used to describe similar elements.

Upstanding posts are usually fixed to the base or floor to extend upwardly therefrom to the ceiling or like, and I have used the numeral 39 to designate one of these fixed posts which in the operation of this particular form of apparatus functions as an immovable element. In this form of the invention the fixed member 1 is provided with a pair of longitudinally spaced apart linked chains 41. Each of such chains being fixed or anchored at one end to the fixed member, as at 43, and the other end of each chain is provided with a hook 45 which is removably attachable to any suitable lug or the like which is provided on the fixed member 1. In the use of this form of my invention the fixed member 1 is releasably attached to the post 39 by means of the chains 41 which are extended about the post from the anchored end 43 so that the hook 45 may be removably fixed to a lug or the like which is provided on the fixed member 1.

It will now be appreciated that with the chains 41 embracing the post and fixed at each end to the fixed member 1 the fixed member 1 will be removably attached to the immovable element or post 39 so that the fixed member 1 will be immovable and the winch may be operated in the same manner as it will be operated in FIG. 1 of the drawings. By using a link chain it will be understood that the length of the chain may be varied in order to fit posts of differing thicknesses. It is further to be recognized that in this form of my invention the fixed member 1 may or may not be provided with the pointed end 3.

What is claimed is:

1. An apparatus for moving objects, including, in combination, an elongated fixed member, a winch mounted on said fixed member adjacent one end thereof, a cable operatively connected to said winch and coilable thereon upon operation of the winch, said cable being removably affixed to an object to be moved and said fixed member being provided with means causing said fixed member to be rigid and immovably fixed in a desired position, wherein said means is provided on and extends along a major portion of the length of said fixed member and comprises a base having two substantially flat faces, one of said faces being in fixed engagement with a surface of said fixed member, an upstanding strengthening rib being provided on the other face of said base and extending longitudinally therealong, and one of the ends of said fixed member being pointed for embedment in the ground.

2. An apparatus for moving objects in accordance with claim 1, wherein said means extends longitudinally along and from one end of said fixed member to a point adjacent to but spaced from the pointed end of said fixed member, and said means is of reduced width relative to the width of said fixed member and said means extends along a side of the fixed member which is removed from the side thereof to which said winch is attached.

3. An apparatus for moving objects in accordance with claim 1, wherein said strengthening rib is of reduced width relative to the width of said base.

* * * * *